US005331978A

United States Patent [19]

Parker

[11] Patent Number: 5,331,978

[45] Date of Patent: * Jul. 26, 1994

[54] METHOD AND APPARATUS FOR SEPARATION OF HEAVY AND LIGHT PARTICLES FROM PARTICULATE MATERIAL

[75] Inventor: Michael P. Parker, Leighton Buzzard, England

[73] Assignee: Rothmans International Services Limited, United Kingdom

[ * ] Notice: The portion of the term of this patent subsequent to Nov. 12, 2008 has been disclaimed.

[21] Appl. No.: 810,315

[22] Filed: Dec. 19, 1991

[30] Foreign Application Priority Data

Dec. 20, 1990 [GB] United Kingdom ..... 9027714.6
May 24, 1991 [GB] United Kingdom ..... 9111334.0

[51] Int. Cl.[5] ..... A24B 3/06; A24B 3/18

[52] U.S. Cl. ..... 131/109.2; 131/109.3; 131/110

[58] Field of Search ..... 131/109.2, 109.3, 110; 34/10; 209/133, 138, 422, 423, 466, 471, 477, 485, 486

[56] References Cited

U.S. PATENT DOCUMENTS

| | | | |
|---|---|---|---|
| 4,115,256 | 9/1978 | de Zeeuw | 209/466 X |
| 4,278,537 | 7/1981 | Schmidt et al. | 209/486 |
| 4,294,693 | 10/1981 | Brennan | 209/466 |
| 4,411,038 | 10/1983 | Mukai | 209/466 X |
| 5,063,944 | 11/1991 | Parker | 131/109.2 |

*Primary Examiner*—Vincent Millin
*Assistant Examiner*—William M. Pierce
*Attorney, Agent, or Firm*—Diller, Ramik & Wight

[57] ABSTRACT

Apparatus for the separation of heavy and light particles from material which includes means for fluidising and agitating the material to cause heavy particles to sink from the acceptable material and comprising a deck adapted to receive material at a reception end and means for vibrating said deck to cause the material to move longitudinally along it to a discharge end, said deck having a number of longitudinally extending troughs separated by peaks and means for providing an upwardly directed air flow in the troughs characterised by means for causing two or more stratified material separation zones in each trough to classify the material two or more times.

22 Claims, 14 Drawing Sheets

METHOD AND APPARATUS FOR SEPARATION OF HEAVY AND LIGHT PARTICLES FROM PARTICULATE MATERIAL

BACKGROUND OF THE INVENTION

This invention relates to a method and apparatus for separation of relatively heavy and light particles from particulate material and is particularly, although not exclusively, applicable for the separation of objectionable particles from tobacco material, for example from cut or uncut tobacco. Such objectionable particles may be "heavies", for example, coarse cut stem pieces and/or "lights", for example particles of dust. The invention can however also be applied to other particulate materials such as vegetables, paper, and mineral materials, or any other particulate material which requires separation. The invention will be described, however, with respect to tobacco materials.

In processing, different tobacco components are treated in different ways before being combined to form the final blend. For example, lamina undergoes a different conditioning treatment to stem and is cut more finely. If there is some cross-contamination of tobacco type such as stem on lamina or lamina on stem, problems will occur after cutting. After cutting, some of the stem in lamina will be so coarsely cut it will be deemed to be objectionable and some of the lamina will be so finely cut it will, in the latter stages of processing, be rendered to dust. For the maintenance of quality, both the overtly large and small particles must be removed from the tobacco prior to being manufactured into the cigarette rod.

One way of removing objectionable particles has been provided for in cigarette making machines, in that prior to forming the unwrapped cigarette rod, the tobacco in the machines is passed through a winnower and air lifted. In passing through the winnower , some heavy objectionable particles are removed. In air lifting, some of the dust passes through the machines to be removed by filtration before the air is exhausted to the atmosphere . Both of these processes are inefficient and remove only a portion of the objectionable material present. Their efficiency is also load dependent, that is, the more objectionable material present, the lower their efficiency. Their discrimination of the winnows is also poor, resulting in acceptable material being rejected with the objectionable.

Another method of removing objectionable material for example is to classify it out by air lifting. These are several styles of classification in existence . These work on the principle that the heavy particles can be separated from the light particles by passing them through a moving stream of air which carries the light particles off with it for separation later, while the heavy particles due to their mass/aerodynamic qualities are left behind.

As the light particles are usually the acceptable and less robust port ion of the tobacco and the air velocities used are in the order of 3,000 ft/min or higher , this form of separation usually results in some degradation of the good tobacco components . Again discrimination between heavy and light particles is poor due to the aerodynamic shadowing and the very short time in which separation occurs .

U.S. Pat. No. 4,646,759 shows apparatus for the separation of tobacco into two fractions, for example "heavies" and "lights". The tobacco is supplied to a separator unit including a vibrating conveyer and streams of air rising through the conveyer plate lift the lighter particles away. The particles most desirable for use as cigarette filler are pulled away and into an upper collector chamber and there deposited into a collector tray leaving the heavy particles to be discharged separately.

The present Applicants attempted to overcome some of the objectionable aspects of the arrangements referred to above and in their corresponding European Patent Application No. 89309703.0 (Publication No. 0 361 815, published Apr. 4, 1990) which shows a method of separating objectionable particles from host tobacco material and apparatus for carrying out the method are described. The apparatus comprises means for fluidising the material to form a carpet in an air stream, means for simultaneously agitating the material to release the dust and heavy particles and arranging the air flow velocity of the air stream to cause the dust to rise and the heavy particles to sink from the carpet. Means are provided for removing the dust and the heavy particles. Further research into this method and equipment have shown that the stratified air velocities within and over the deck which form the carpet of material can be more efficiently produced by control of the air entering the troughs and the present invention is therefore intended to provide a more efficient apparatus of the kind referred to in European Patent Application No. 89309703.0.

SUMMARY OF THE INVENTION

According to the present invention apparatus for the separation of heavy and light particles from particulate material which includes fluidising and agitating the material to cause heavy particles to sink from the acceptable material, comprises a deck adapted to receive material at a reception end and means for vibrating said deck to cause the material to move longitudinally along it to a discharge end, said deck having a number of longitudinally extending troughs separated by peaks and means for providing an upwardly directed air flow in the troughs characterised by means for causing two or more stratified material separation zones in each trough to classify the material two or more times.

Heavy particles sinking from the upper layer often drag down with them acceptable material. Because of the effect of the second lower separation zone and the agitation an opportunity is provided for further separation and for the retention of good particles of material which become separated from the heavy particles in the second separation zone.

Means can be provided for varying the velocity of the upwardly directed air in each trough to cause the two or more stratified material separation zones.

Preferably each trough has walls, and a mouth extending between adjacent peaks, the air flow in each trough creating a first separation zone in which is formed a first upper fluidised separation layer which creates a carpet of material a portion of which is in the trough below the peaks but spaced upwardly away from a second lower separation zone, formed in the trough.

The velocity of the fluidising air passing upwardly in said trough can be sufficient to create said second lower separation zone to then decrease and then increase again to a location spaced upwardly away from the second separation zone to create said first upper separation zone and then decrease as it exits the mouth of the trough.

The control means can include the shape, and/or pattern and/or dimensions of air openings in the walls, guide means for controlling air flow through the wall openings, the shape of the trough or any combination.

The cross-sectional shape of the trough defined by its walls can include a venturi.

In one embodiment the second lower separation zone acts to return any acceptable material which may have sunk with the unwanted heavy particles to the first upper separation zone, and the second separation zone can be located beneath the venturi.

Alternatively the second separation zone can be arranged beneath the venturi.

If desired the trough defined by its walls can include two venturis.

In a preferred embodiment the lower separation zone creates a second fluidised separation layer spaced below said first fluidised separation layer and from which heavy particles sink.

With this arrangement the second separation layer may support material of substantially the same weight as the first separation layer or slightly heavier and the second separation layer can be located above the venturi.

The increase in air velocity to create the second layer can be caused by the restriction of air into the trough through the opposed side walls above the venturi.

Means can be included at an intermediate location in the length of the deck to cause the second lower separation layer to cease and for the material therein to be lifted into said first separation layer prior to discharge.

The second separation layer can be deleted by the admission of an increase of the additional air into the trough through the side walls.

Means can be provided for lifting material which has fallen through one or both of the separation zones, back into a separation zone for re-separation.

This construction also assists in preventing loss of good material, because the heavy particles are lifted upwardly back into the separation zones there is again the opportunity for separation of good material clinging to them.

Preferably the heavy particles are lifted upwardly by mechanical/air ramps or deflectors in the lower part of the trough.

The apparatus can include means for threshing said heavy particles at said discharge location and subsequently separating out any lighter material.

Thus, the threshing of the heavy particles tends to release lighter material which can be recirculated for further classification in the apparatus, or added to the discharged material.

Preferably the threshing means include a hammer mill.

The invention can be performed in various ways and some embodiments will now be described by way of example and with reference to the accompanying drawings which show apparatus for treating tobacco material and in which:

DESCRIPTION OF THE PREFERRED EMBODIMENTS

Figure 1:
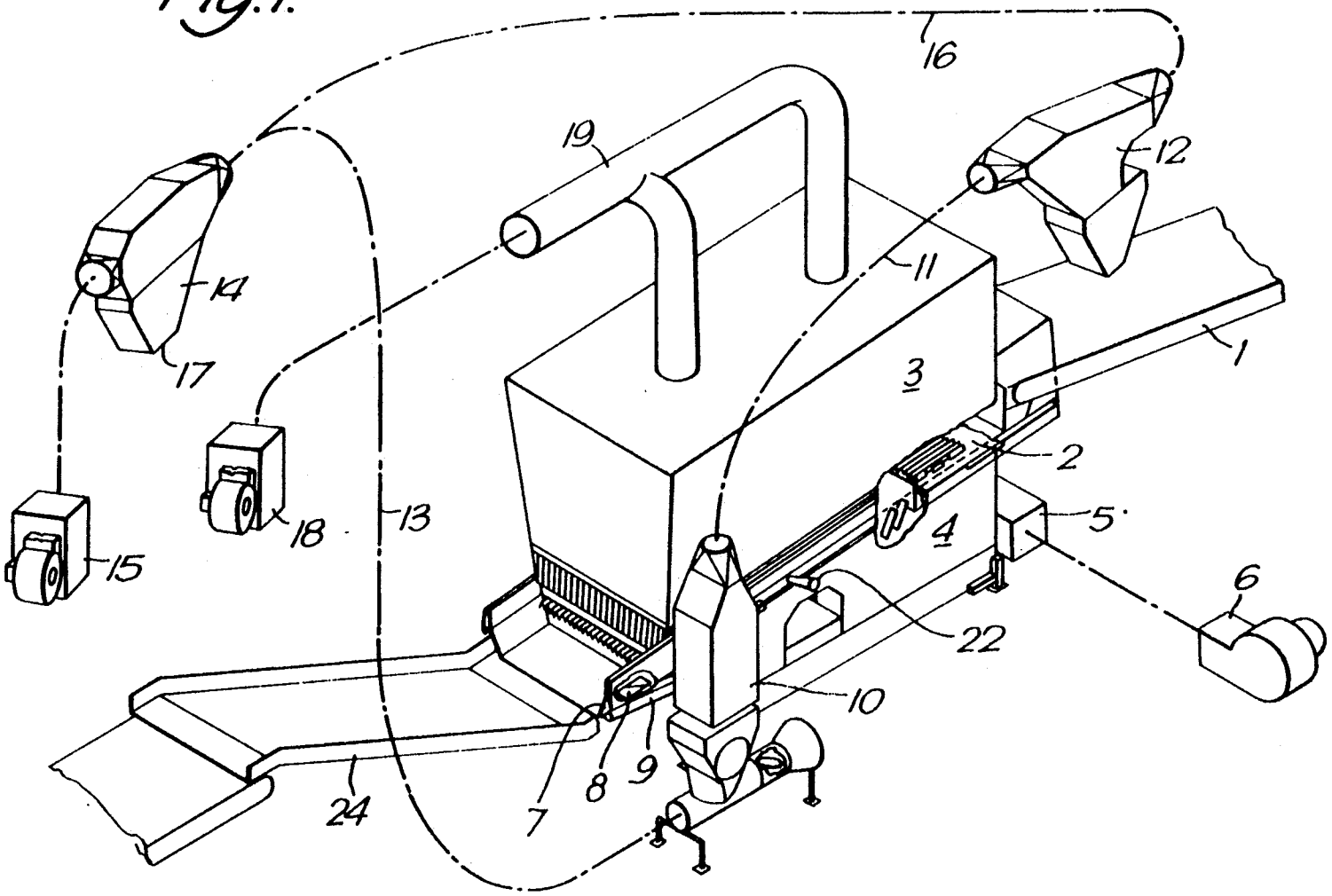
FIG. 1 is a diagrammatic view of an embodiment of the apparatus as shown in European Patent Application No. 89309703.0 ( Publication No. 0 361 815) to which the present invention can be applied.

The apparatus shown in FIGS. 1, 2, 3 and 4 of the drawings, is as shown in European Application No. 89309703.0 and is an example of apparatus to which the present invention can be applied. As shown in FIGS. 1, 2, 3 and 4 the apparatus comprises a feed conveyer 1, which transports tobacco material to be treated onto a vibrating fluid bed deck 2. If desired, the tobacco having left conveyer 1 can be teased by a stream of air which acts to spread, separate and untangle the material. As the material reaches the deck 2, means can be provided to further spread it evenly over the full deck width, for example by means of a baffle (not shown). The deck 2 is inclined and its vibratory action causes the tobacco to be transported along it. A flared hood 3 is provided and beneath the hood a combination of perforated and/or perforated and plain, and perforated sheets with slots is used to cause the tobacco to become fluidised with the combination of the deck's vibrating action and air velocity introduced from a plenum 4 beneath the deck 2. Air is introduced into the plenum through suitable ducting 5 from a fan 6.

The deck beneath the hood 3 is corrugated to provide higher air velocity at its peak than in its troughs. Heavy particles fall through the fluidised carpet of tobacco thus produced which is teased open by the action of the air and vibration and fall into the troughs between the peaks of the corrugated bed. Slots are provided through which the heavy particles fall, and the air-flow through the slots is set so that it cannot support the heavy objectionable material.

Collators (not shown in FIG. 1) are arranged beneath the slots which transport the heavy material to a gallery 7 at one side of the bed 2 and the material progresses down the gallery to window 8 through which it falls onto a conveyer 9. Conveyer 9 lifts the particles to a classifier 10 where any acceptable tobacco in the heavy particles is segregated and re-cycled by being passed through a ducting 11 to a separator 12 through which it is returned to the loading conveyer 1. Heavy objectionable particles are dropped out of the bottom of the classifier 10 and are passed through ducting 13 to a separator 14 from which they are ejected at 17. An extraction fan filter is indicated by reference numeral 15. Ducting 16 returns are from the separator 12 via the separator 14 to the fan filter 15.

Light objectionable particles such as dust are lifted above the top of the fluidised carpet of tobacco by the air-stream and taken to a fan-filter 18 via extraction ducting 19 leading from the top of the hood 3. As the hood 3 is flared from bottom to top, the air velocity within it is reduced from bottom to top. This prevents the fluidised carpet of tobacco from being lifted beyond fluidisation and ensures that any acceptable particles of tobacco entrained in the fluidised air drop out as its velocity reduces before it is extracted from the hood.

The air used to fluidise the tobacco can be of a specific temperature and RH to influence the final temperature and moisture of the tobacco at the discharge end of the vibrating bed 2.

Throughout the whole process, the bulk of the acceptable tobacco is supported on a cushion of air which produces the fluidisation required and this gentle form of support prevents the host tobacco from degrading.

Figure 2:
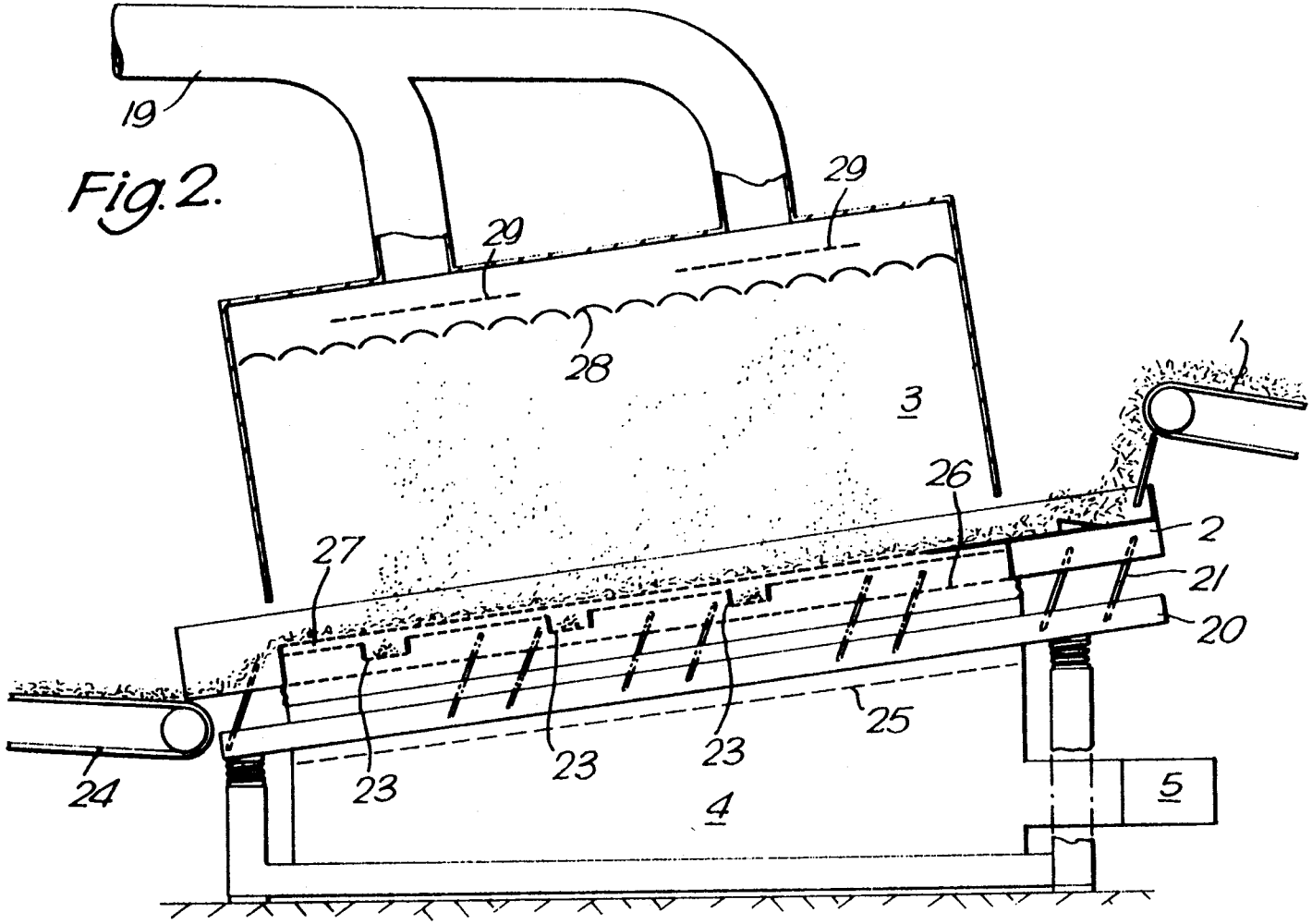
FIG. 2 is a diagrammatic cross-section through part of the apparatus shown in FIG. 1.

FIG. 2 is a diagrammatic cross-sectional view of part of the apparatus and the same numerals are used to indicate similar parts as in FIG. 1. As will be seen from FIG. 2, the vibrating deck 2 is carried on a spring-mounted frame to which it is connected by fibreglass springs 21. The deck is vibrated by a drive-arm 22 as shown in FIG. 1 and the collectors of the "heavies" are shown as channels 23. The cleaned, cut lamina emerging from the deck is delivered to a removal conveyer 24. Reference numeral 25 indicated a baffle in the plenum which acts to distribute air and reference numeral 26 indicates a further baffle in the base of the deck. The convoluted deck is preferably made with a 10% open area from perforated sheet and is indicated by reference numeral 27, but larger or smaller cores of perforation could be used.

An air deflector 28 is provided in the upper part of the hood 3 and baffles are indicated by reference numeral 29.

Figure 3:
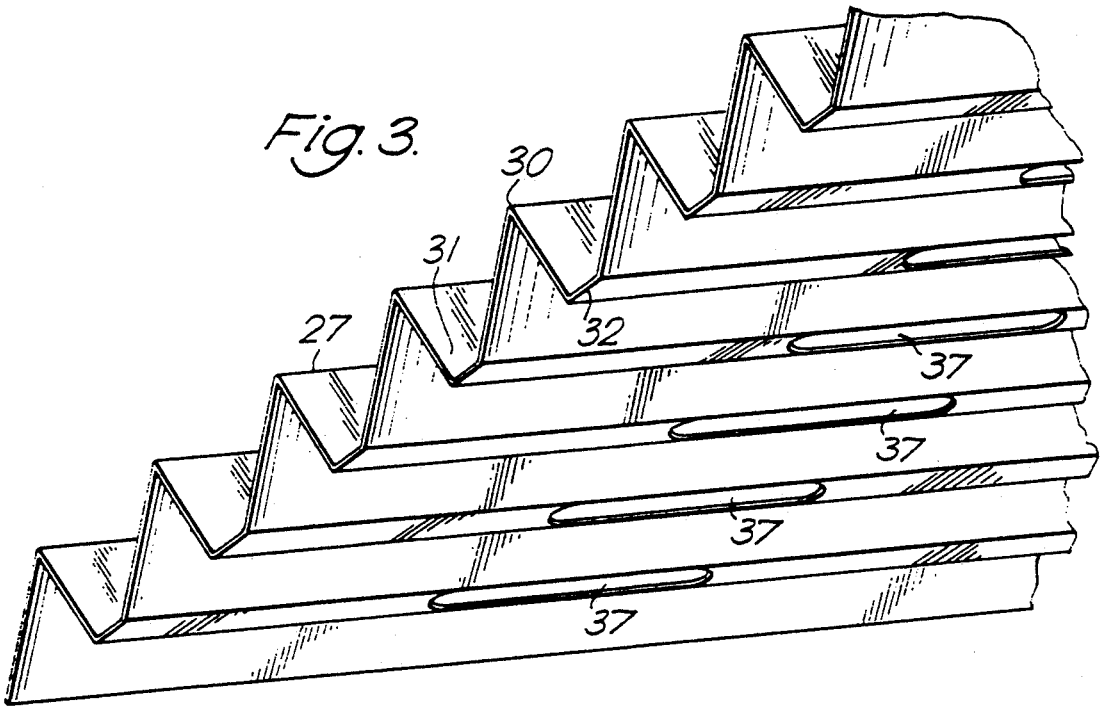
FIG. 3 is an enlarged perspective view of part of the fluidised bed deck shown in FIG. 1.
Figure 4:
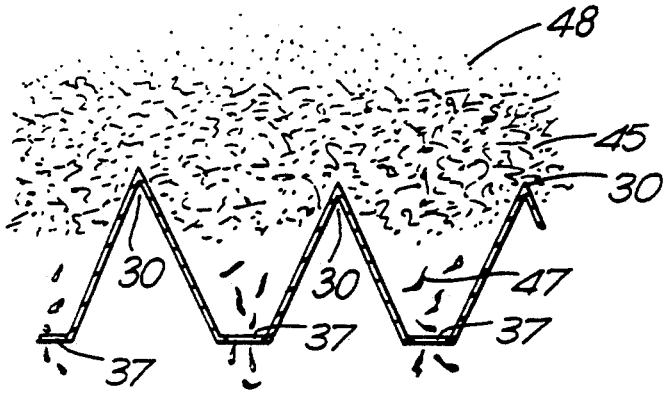
FIG. 4 is a diagrammatic view showing the relative position of a tobacco carpet on the fluidised bed deck shown in FIG. 1.

The construction of the vibrating deck is shown more clearly in FIGS. 3 and 4. FIG. 3 shows the corrugated deck surface with the peaks of the corrugations indicated by reference numeral 30 and the troughs by reference numeral 31. The bottom 32 of each trough is flat and the whole construction is made from perforated material so that an air flow can be passed through it. As will be seen from FIG. 2, the corrugated surface is carried on the perforated channels 23, which are connected on each side to lengthwise extending box section galleries. Reference to FIG. 3 will show that a row of slots 37 is provided which extends angularly across the deck, each slot being located at the bottom of one of the troughs 31. A collector channel 23 is located beneath each row of slots. The channels 23 are made from a perforated material to allow an appropriate air flow through them for the fluidised bed.

FIG. 4 shows how the carpet of tobacco material indicated by reference numeral 45 is located by the fluid bed in relation to the corrugated surface provided by the deck of the bed. Approximately one third of the carpet impinges into the channels below the peaks 30 although it will be appreciated that there will be large fragments falling from the lower surface, indicated by reference numeral 47 and dust and other smaller fragments indicated by reference numeral 48 rising above it. As the peaks of the deck extend into the carpet of material, vibration of the deck is transmitted to the material, thus teasing it while it is in a fluid state. Moreover, because the vibration is transmitted to the carpet of material, it helps to move it down the conveyer thus ensuring a rapid throughput of material. It has been found that a relatively thin layer of material transported rapidly through the conveyer is more effective than moving a much thicker layer at slower speed.

Due to the angled construction of the collector channels 23, heavy material which has fallen through the openings 37 is transported across the deck and into the galleries. Because the whole deck is vibrating, the gallery 37 now acts as a conveyer to move the heavy material to the position indicated by reference numeral 8 in FIG. 1 so that it can be removed.

Figure 5:
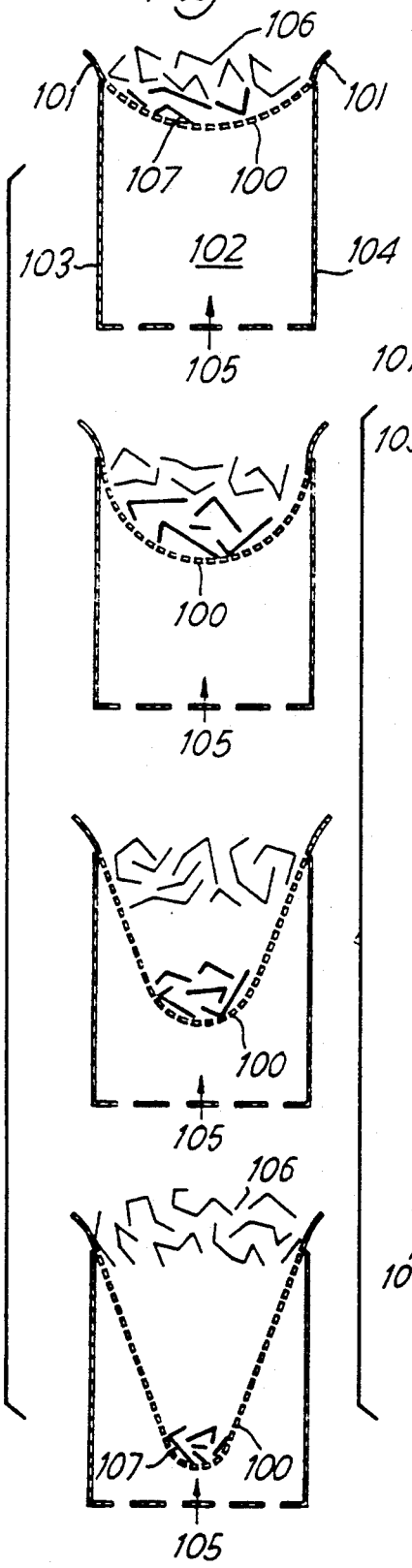
FIGS. 5 , 6 and 7 are diagrammatic representations showing the principle of progressive separation of acceptable tobacco material from heavier material.
Figure 6:
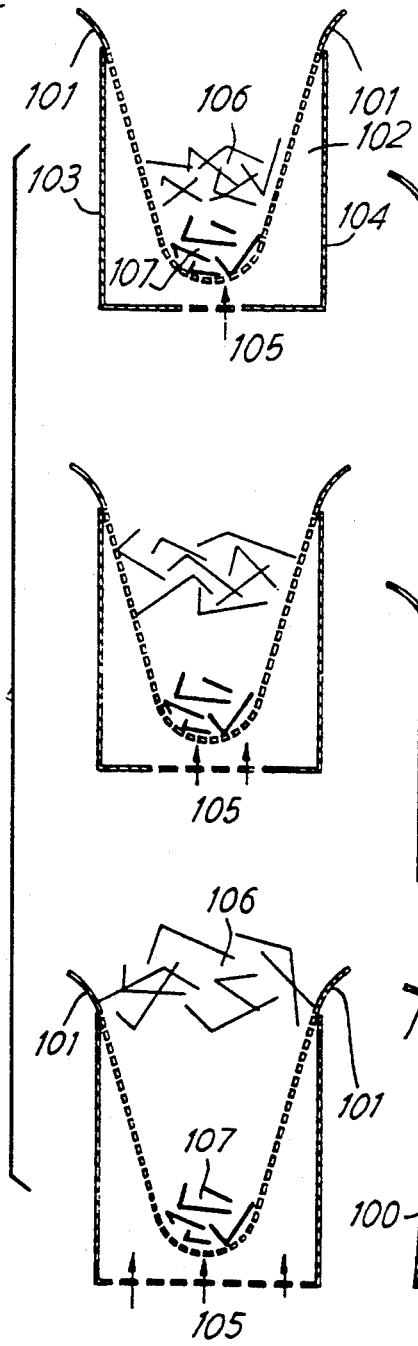
Figure 7:
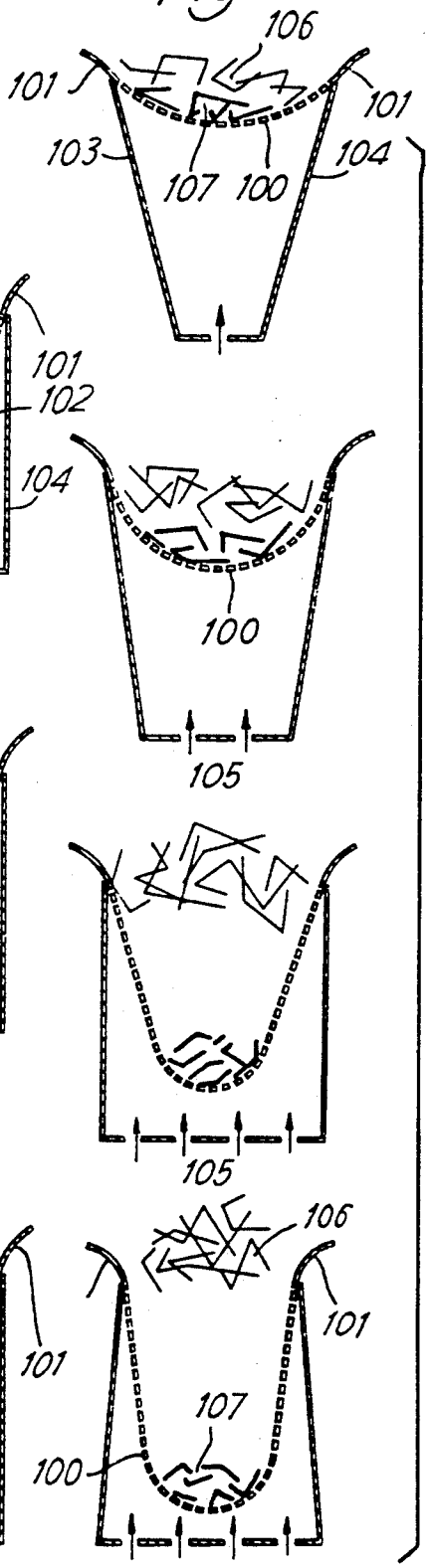

Investigations have shown that the progressive separation of acceptable tobacco material from the heavier material can be achieved progressively and FIGS. 5, 6 and 7 show such progressive separation principles.

In these three Figures a perforated trough is indicated by reference numeral 100, the peaks at each upper side of the trough are indicated by reference numeral 101 and air is supplied to the underside of the trough through a duct 102 having baffle side walls 103 and 104.

FIG. 5 shows four stages of progressively altering the shape of the trough 100. Thus at the top of the Figure the trough is a flat curved shape and is progressively curved bringing the curve in steeper as shown at the lower end of the Figure. With a constant air flow indicated by arrow 105 the lighter acceptable tobacco indicated by reference numeral 106 progressively separates from the heavier material 107 and at the bottom of the Figure it will be seen that the light acceptable material 106 has remained at the top of the trough between the peaks 101 and the heavy material 107 is now clearly spaced away from it at the bottom of the trough.

FIG. 6 is a similar schematic progressive diagram showing how with a trough shaped substantially as shown at the bottom of FIG. 5 separation can be achieved by progressively increasing the volume of air available to the underside of the perforated shape. Thus at the top of the Figure the air inlet for air flow 105 is relatively small but at the bottom of the Figure the air inlet extends across the whole width of the duct.

FIG. 7 illustrates the use of combined control of air volume by entry size and distribution control by shape of the duct can provide separation. The same reference numerals are again used to indicate similar features. It should be noted that the bottom diagram in FIG. 7 is not to scale, the width of the mouth of the trough should be the same as that in the diagrams above it. From this it will be understood that with this last arrangement the base of the duct is wider than the width across the throat of the trough between the peaks 101. Alternatively the width of the mouth of the trough can be smaller than those shown above it, illustrating that progressive separation can be achieved individually, or by a combination of a progressive increase in the curve of the perforated material, an increase of the volume of air (and hence its pressure) below it or by an increase of the velocity of the air at the peaks of the curve by reducing the width of the curve in this area.

From FIGS. 5, 6 and 7 it will be appreciated that the use of baffle walls 103 and 104 enables careful control of the the air flow through the bottom and opposed side walls of the trough to give accurate control of the separation and the separation layer represented by the acceptable material is held up by the velocity of the air flow immediately beneath it, this air flow being insufficient to lift the heavy material 107.

When applied to operative constructions the heavy material can be removed by any conventional arrangement, for example, through openings in the bottom of the trough as shown in FIG. 4.

Figure 8:
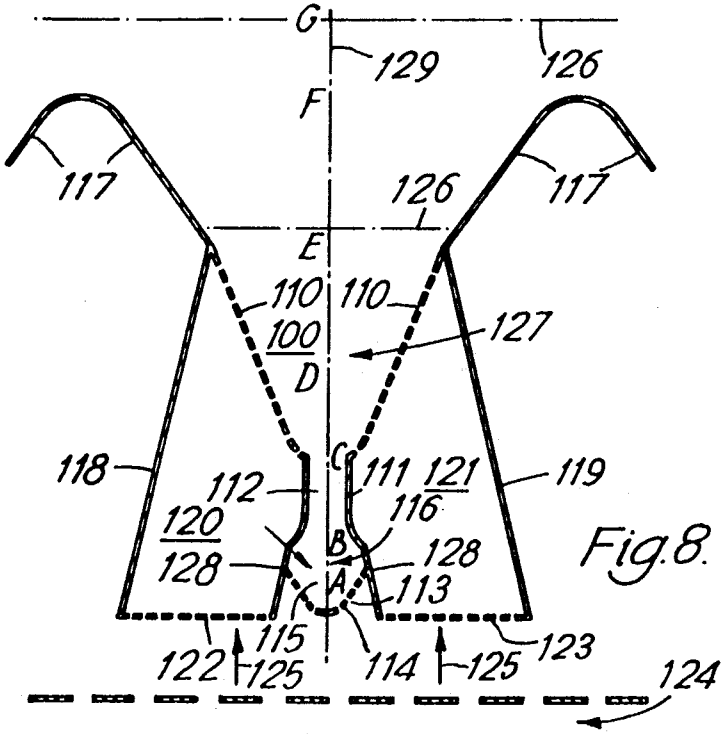
FIGS. 8 is a cross-sectional diagrammatic view of a trough in a deck incorporating the present invention.

For some tobaccos it is desirable to provide means to allow good material which has inadvertently sunk to the bottom of the trough to be re-classified as the heavy material can drag good material down with it. FIG. 8 shows a construction according to the present invention which provides for this and can be applied to the apparatus described above and shown in FIGS. 1 and 2.

FIG. 8 is a cross section of one trough in a deck, the trough being indicated by reference numeral 100. The trough has opposed side walls 110 and a lower portion 111 which is shaped to form a venturi indicated by reference numeral 112. The bottom 113 of the trough is provided by a perforated screen 114 which is shaped to form a channel 115 in the bottom of the trough. The area between the screen 114 and the entrance to the venturi 112 acts as a longitudinally extending agitation chamber 116. The upper portion of the trough 100 is formed by angled walls 117 which form peaks between the troughs. In FIG. 8 two peaks are shown each side of the trough.

The side walls 110 and the part of the lower portion 111 which does not constitute the venturi are perforated and air guide means are provided by longitudinally extending baffle means in the form of spaced apart baffle walls 118, 119 which extend downwardly from the points where the side walls 110 merge into the upper walls 117, that is immediately beneath the peaks through points essentially level with the bottom 113 of the trough.

Air is supplied to air control chambers 120, 121 formed by the baffle walls 118, 119 through perforated walls 122, 123 from a plenum chamber 124 below the deck, air entry being indicated by arrows 125.

The volume of air passing through the shaped trough 100 on each side of the venturi 112 is controlled by the baffle plate angle/perforation pattern/open control chambers 120, 121 formed by the baffle walls around the trough 100.

The appropriate air pressure to the air control chambers 120, 121 around the trough together with the shape of the trough creates a first fluidised separation zone indicated by broken lines 126. Tobacco material in this zone forms a layer in the form of a carpet, the lower portion of which extends below the level of the peaks and into the mouth of the trough and the air velocity is such that heavy unwanted material indicated by reference numeral 127 sinks downwardly. These unwanted heavies 127 fall through the venturi 112 and into the agitation chamber 116. The velocity of air entering the chamber 116 through the screen 114 control the velocity of the air which is below a point A indicated on the drawing. As will be seen this perforated screen 114 is shaped as a channel to encourage stems to orientate lengthwise on it and settle below the point A.

Any good piece of lamina however which has perhaps been dragged down by a stem or has fallen through the venturi 112 will, by turbulence in the region A, lift to the area indicated by reference letter B and, subsequently, if they are light enough, pass back through the venturi 112 to the point C and be ejected back into the main air stream in the trough to rise to the carpet 126 thus leaving only heavy objectionable material behind in the channel.

Thus, it will be seen that this construction provides two separation zones, the first separation zone being at the level of the carpet 126 and the second being beneath the venturi 112 in the chamber 116.

For trimming purposes both the perforated screen 114 and/or the perforated lower walls 122, 123 can be masked.

If desired the air opening in the wall of the trough can be patterned and/or of different dimensions to provide a controlled flow, and it is also possible by the use of such patterning to dispense with the baffle walls 118, 119 which act as air guides in the construction shown.

The portion of the walls 111, 112 below the screen 114 is solid to provide air guiding into the shaped screen.

Figure 12:
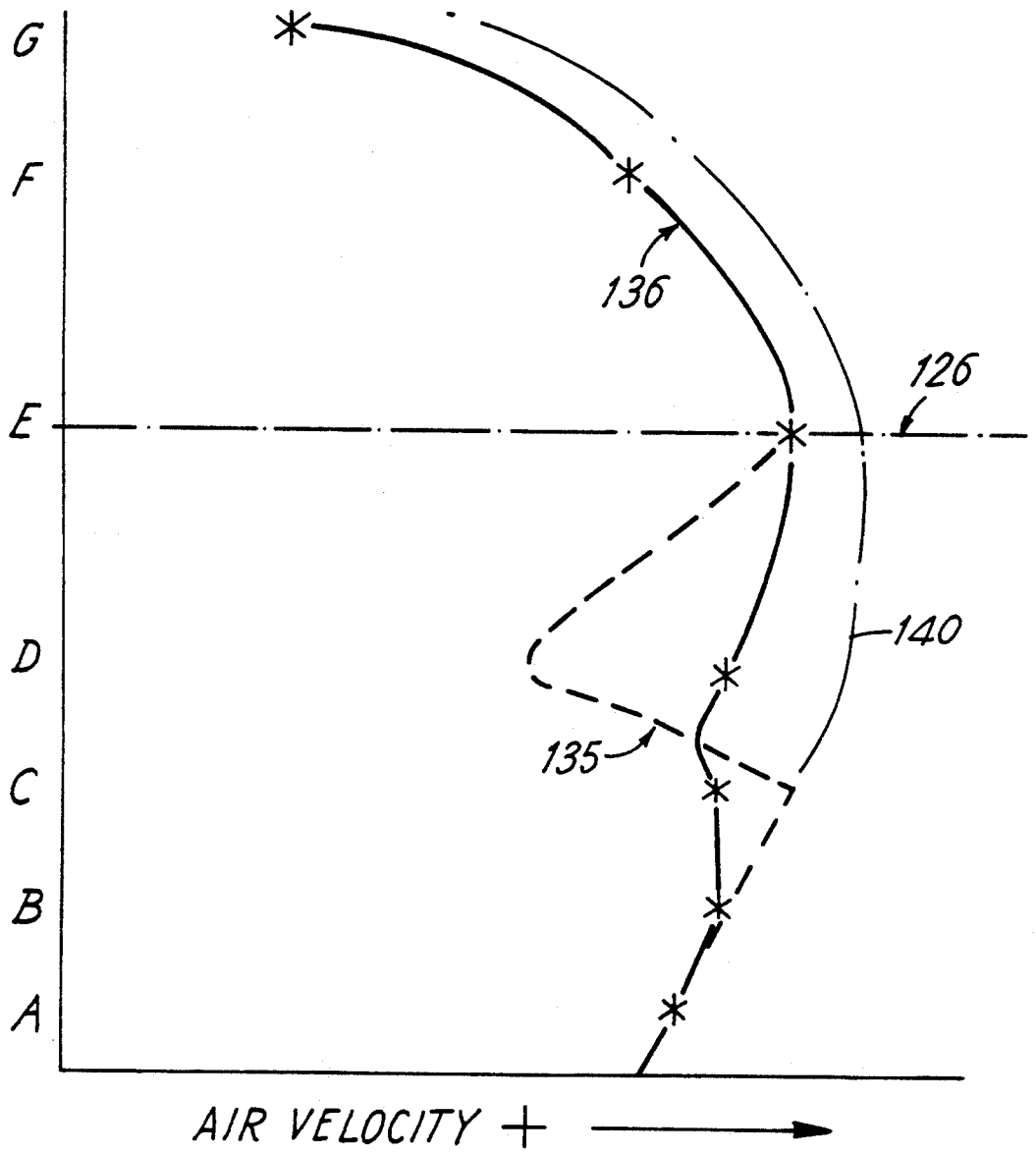
FIG. 12 is a graph showing relative air velocities through the troughs shown in FIGS. 8, 10 and 11.

FIG. 12 is a graph in which the relative air flow velocities at the various points through the trough along the centre line indicated by broken line 129 in FIG. 8 is shown as a solid line. It will be seen that the venturi which lifts the light material back out of the turbulence chamber 116 creates an increasing air flow velocity between point A and point C, there is a slight drop in velocity as it leaves point C but the velocity then increases again to the point E which is the lower level of the carpet 126, the air velocity then again decreases up to the point G so that the carpet 126 is maintained in the desired position, that is with its lower level within the throat of the trough. The lower level of the carpet is also indicated by a broken line 126 on FIG. 12.

Figure 9:
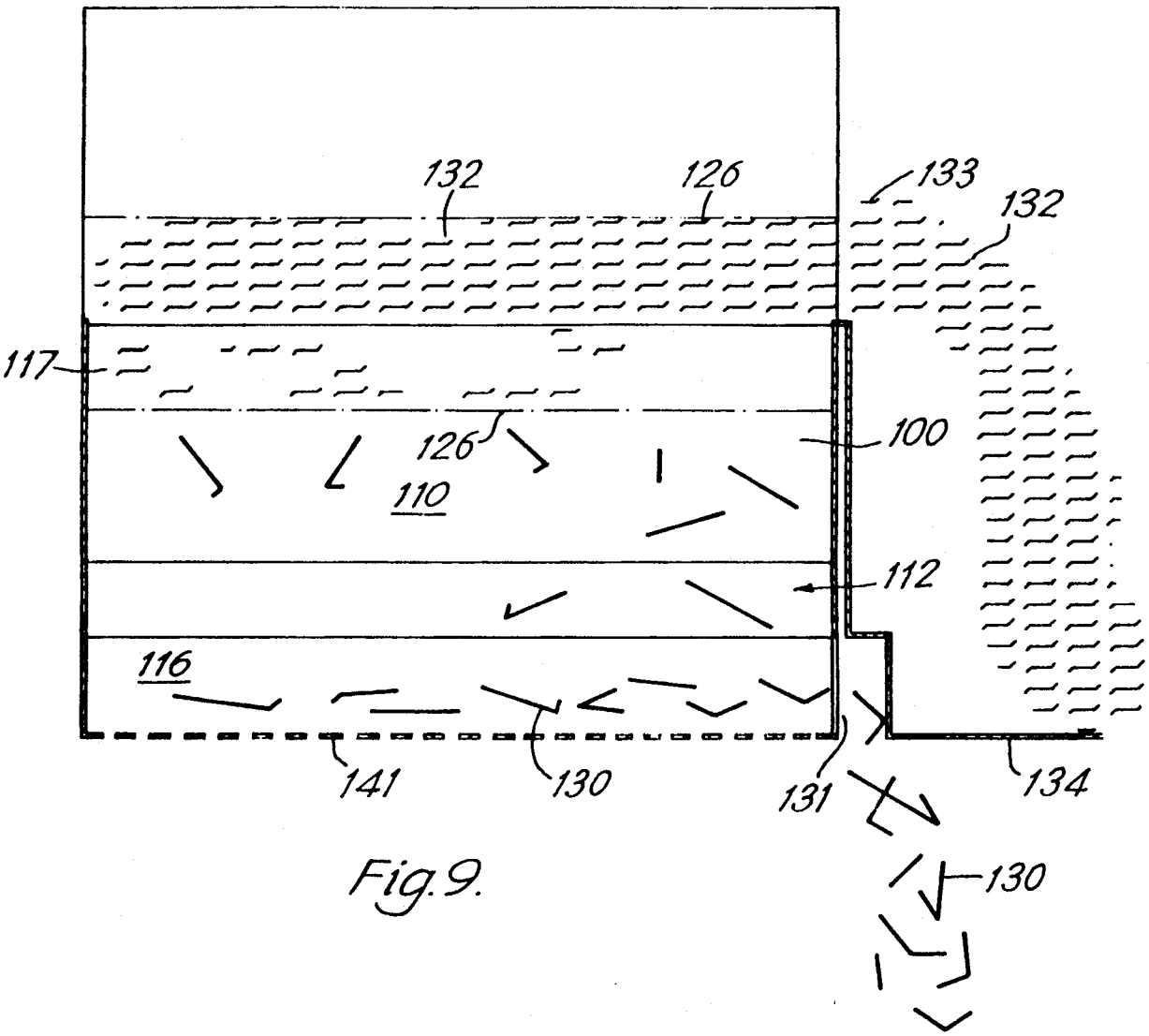
FIG. 9 is a cross-sectional diagrammatic side view of a construction embodying a bed provided with troughs as shown in FIG. 8.

FIG. 9 is a diagrammatic cross-sectional view of the apparatus from which it will be seen that the heavy material, indicated by reference numeral 130 can be carried to the discharge end of the deck by the channel shaped screen 114 and discharged at a point 131. The good material, indicated by reference numeral 132 is taken off the deck at a higher level and discharged at a point 133, suitable screening 134 being provided to accommodate and separate the two layers.

This construction can be used where the venturi is continuous throughout the length of the trough or it can be used for a long final discharge opening. If the construction is used as a final discharge opening in combination with other constructions the take off arrangements would be set with an air flow commencurate with only letting larger heavies through. The air flow through the venturi at the discharge end of the deck can be arranged to be higher than at its feed end by simple masking or making the appropriate design to the geometry of the shapes below the venturi.

Figure 10:
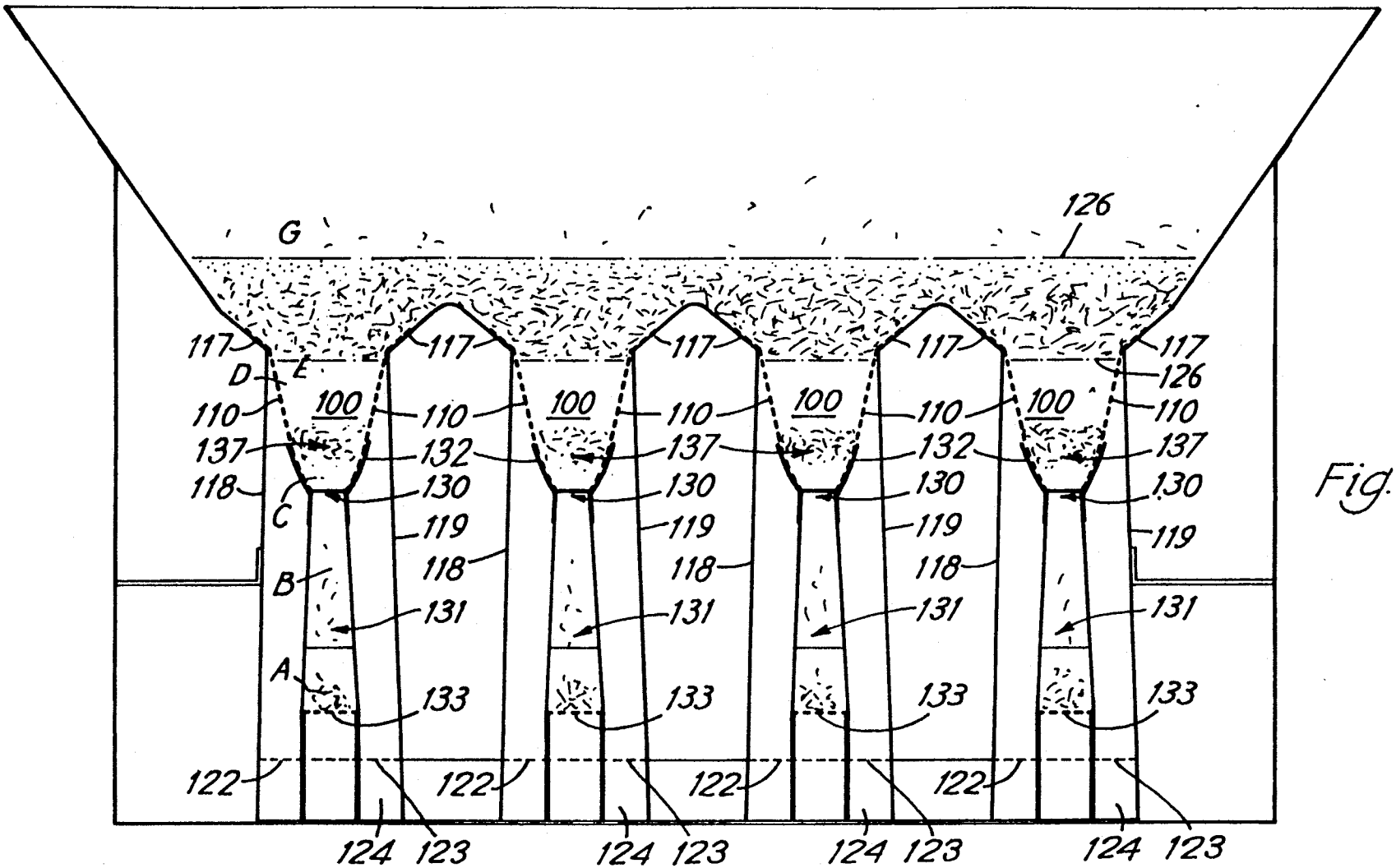
FIG. 10 is a diagrammatic cross-sectional view through an alternative form of a deck according to the present invention looking towards the charge end, taken on line X—X of FIG. 13.
Figure 11:
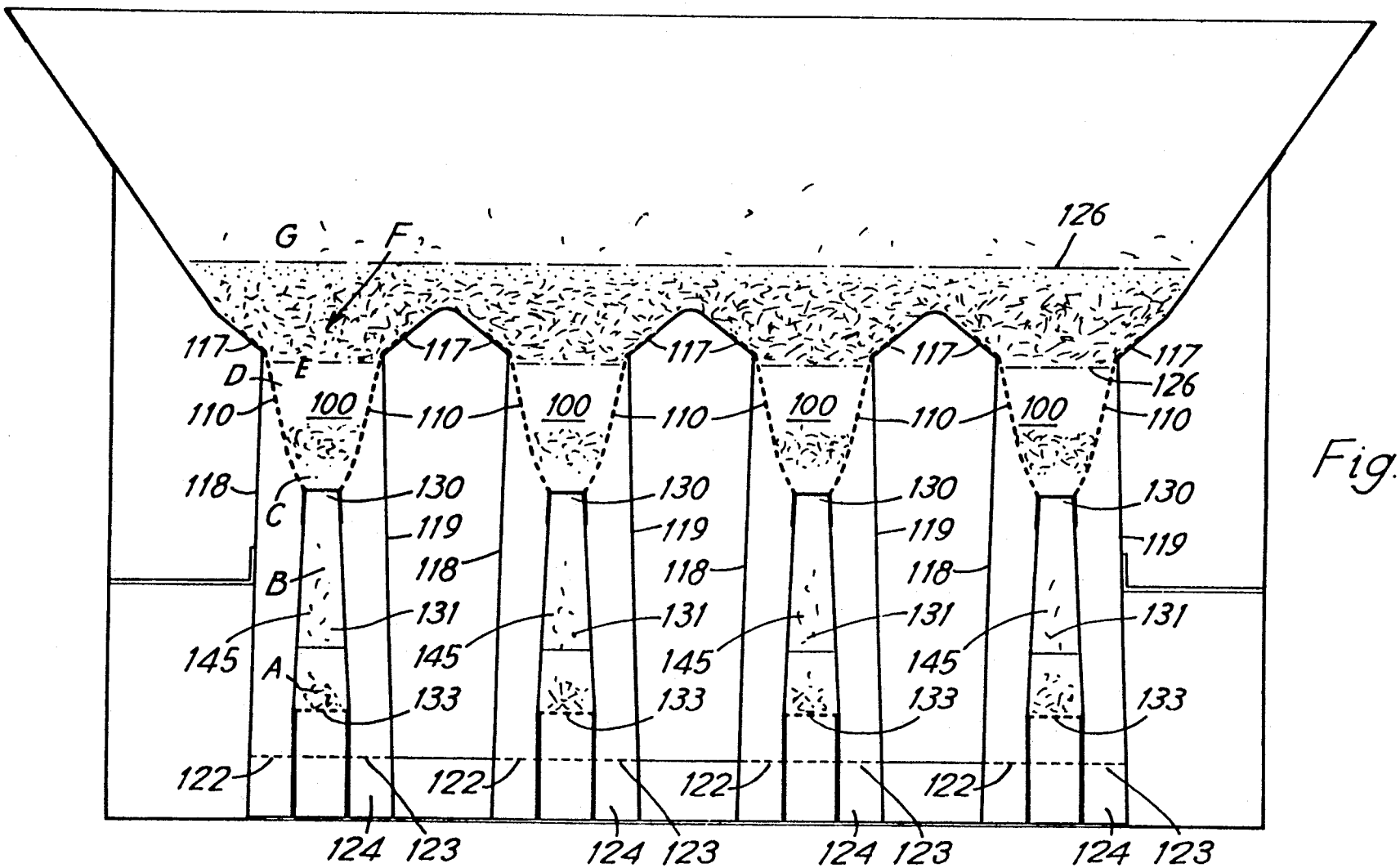
FIG. 11 is a diagrammatic cross-sectional view through the deck shown in FIG. 10 looking towards the discharge end and taken on the line XI—XI of FIG. 13.

FIGS. 10 and 11 show an alternative construction in which the second fluidised separation zone is located in the troughs above the venturis and so that it forms a second lower separation layer.

FIG. 10 is a diagrammatic cross-sectional view looking towards the charge end of the deck and the same reference numerals are used to indicate similar parts as in FIG. 8. In this construction therefore the carpet of tobacco material is again indicated by reference numeral 126 and the lower portion of which extends below the level of the peaks and into the mouth of each trough. As will be seen from FIG. 10 the shape of the trough is different to that shown in FIG. 8 in as much that the venturi 130 has a longer tapering lower section which is indicated by reference numeral 131. In this construction the part of the trough immediately above the venturi is either made from solid material or is enclosed in solid shrouds 132 so that additional air only enters the trough 100 at a distance spaced above the throat of the venturi. The lower part of the venturi 131 terminates in a lower perforated wall 133 which, together with the lower side walls of the venturi, provides a channel.

With this construction the air flow velocity through each channel 100 is as shown by the broken line 135 and the upper part of the solid line 136 in the graph shown in FIG. 12. From the graph it will be seen that the air flow increases in velocity to the throat of the venturi 130 where it dies away and then increases again to the level E where it again dies away up to G, as indicated in the solid line 136 on the graph. The first increase in velocity up to level C and then decrease creates a second layer 137 of tobacco material which has sunk from the upper layer 126. In operation therefore material which is supplied to the deck is agitated and fluidised and heavy material, perhaps dragging down good material with it, falls into the troughs, as it passes through the second classification zone it is again classified but this time more effectively because there is less of it and it has a chance for better separation, heavy unwanted material again falls from this second layer to the base of the trough and into the channel above the perforated base 133.

In the arrangement shown in the graph it will be seen that the velocity of the air in the venturi is slightly greater than the velocity at the level E so that slightly heavier material will also be retained, along with the light material, at the second layer 137. This therefore provides a further opportunity of classifying the unwanted material and retaining some of it which might otherwise be rejected in the upper classification layer 126. If desired however the air flow could be arranged so that the retained material at the second layer 137 was of the same weight or even slightly lighter than that in the layer 126.

FIG. 11 is a diagrammatic cross-section of the deck looking towards the discharge end and the construction is substantially the same as that shown in FIG. 10 but in this case the walls of the channels immediately above the venturis 130 are not blanked off so that there is an increased air flow through the perforated side walls 110 of the channels as compared with the air flow shown in FIG. 10. The velocity of the air flow is shown on the graph in FIG. 12 by the chain dot line 140, part of the broken line 135 and the lower part of the solid line 136. It will be seen that there is a constant rise in air velocity through the venturi and up the perforated part of the troughs due to the additional air supplied through the perforated wall. This starts to die away above the level E to support the upper layer 126.

Figure 13:
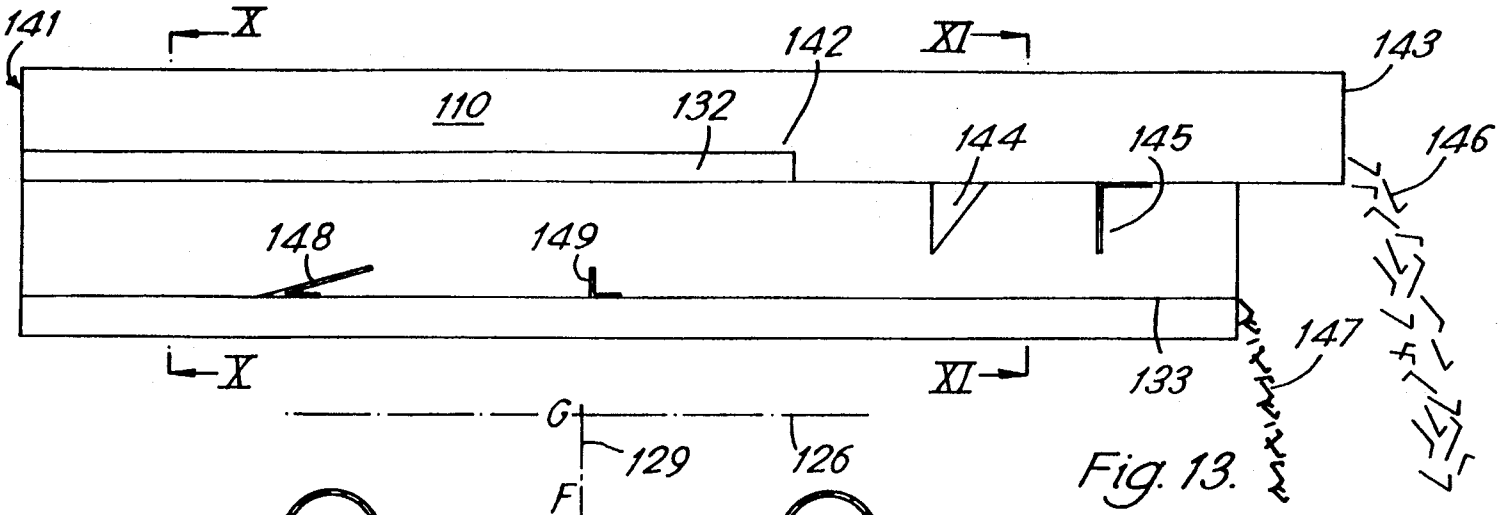
FIG. 13 is a diagrammatic side view showing baffles for lifting material from a second layer upwardly into a first layer.

The two constructions are shown together in the diagrammatic side elevation shown in FIG. 13. Thus the construction of the deck as shown in FIG. 10 extends from the charge end 141 of the deck up to a point about two thirds along its length and which is indicated by reference numeral 142. The remainder of the deck is constructed as shown in FIG. 11 up to a point where the heavies are discharged. The increase in the perforated area and consequently the air flow lifts the second layer up to the first.

Baffles do not appear in FIGS. 10 or 11 but are indicated in FIG. 13. These baffles 144, 145 extend downwardly from the level of the throat of the venturi 130 and are provided in the last part of the deck which is constructed as shown in FIG. 11. The baffles 144 first act to lift any stray material left in the second layer 137 to the upper layer 126 and the baffle 145 further acts to lift any remaining material which has escaped baffle 144 and also tends to lift the level of the first carpet. As will be seen from FIG. 13 this produces a layer of acceptable material which is shown discharging at 146 and a layer of heavies in the lower trough of each channel which is shown discharging at 147.

Also shown in FIG. 13 are two deflection ramps 148 and 149 which are located in the channel at the lower part of the trough in the construction shown in FIG. 10. These ramps act on the moving material in the channel to cause it to rise to the second layer and thus help to dislodge any good material which has been carried into the channel by attached heavy material as well as testing the discrimination of the material which was in the channel.

It will be appreciated that ramps of this type can be incorporated in any of the decks described above, whether they have a second air created separation zone or not. Thus ramps of this kind could be included in the construction as shown in FIG. 4 to provide what is, in effect, a second separation zone.

When these ramps are incorporated in the arrangement shown in FIG. 8 they merely assist in the second separation zone in the chamber 116 but when incorporated in the construction shown in FIG. 10 they create a third separation zone located at the bottom of each trough.

Figure 14:
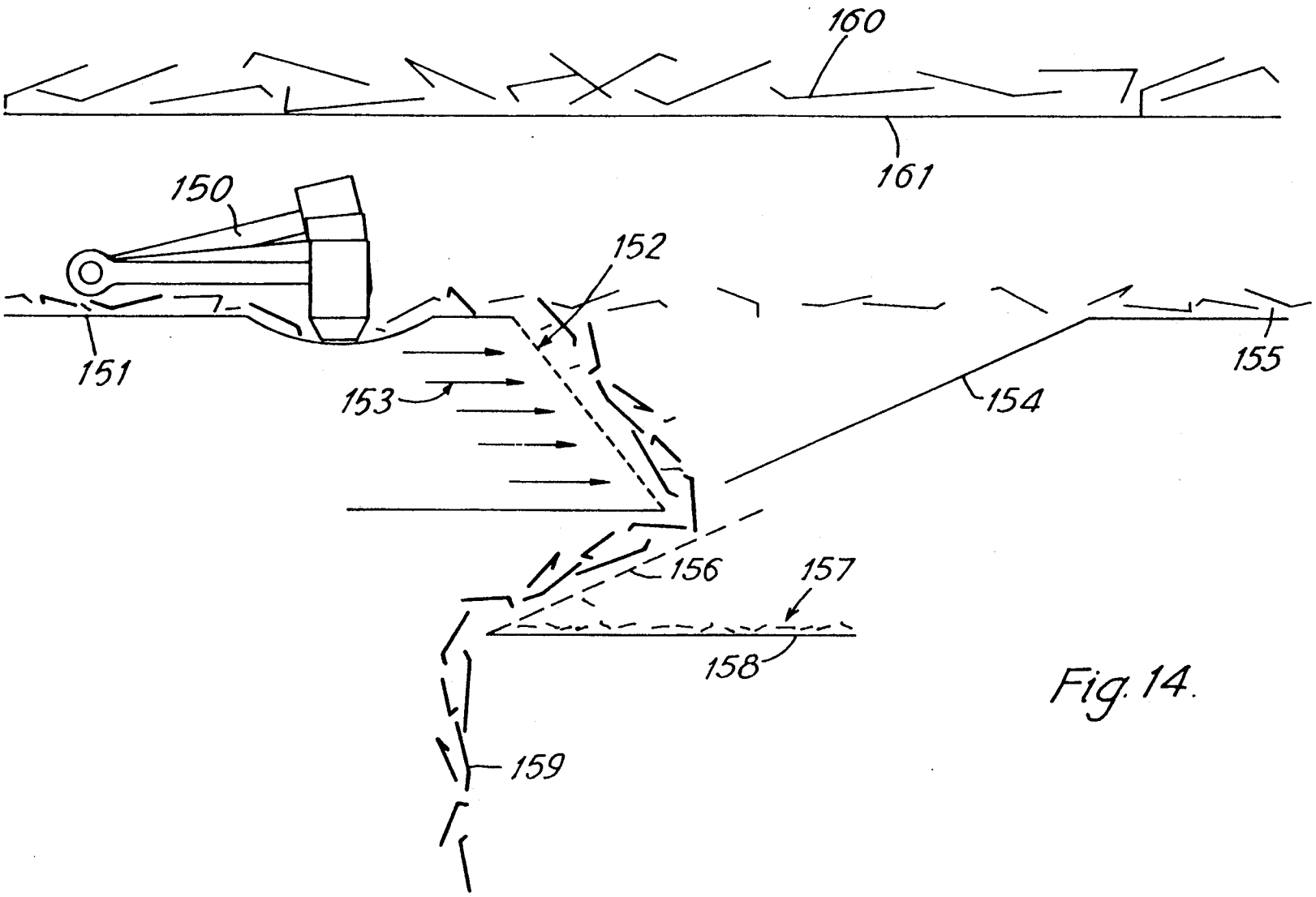
FIG. 14 is a diagrammatic view of a hammer mill provided at the discharge end of the apparatus.

FIG. 14 is a diagrammatic view of a hammer mill which is provided at the discharge end of the apparatus and which acts on the heavy material to produce light material (lights), small material (smalls), and unwanted heavy material (winnows). The hammer mill is of the trip hammer type and is indicated by reference numeral 150. The hammer is located at the level of the bottom of the channels in the troughs which is indicated in FIG. 14 by reference numeral 151. The hammer acts on the heavy material, which comprises stems and other material, and threshes them to produce lights, smalls and winnows. The vibration of the deck delivers the hammered material to a first inclined ramp 152 which has a perforated surface. Air is delivered to this from the plenum chamber, the air flow being indicated by reference numeral 153. The air flow blows the lights away from the other material up a ramp 154 to a discharge point 155. The winnows and smalls fall onto a further perforated ramp 156 through which the smalls fall to form a layer 157 and a support 158 and the remaining winnows fall away as indicated by reference numeral 159.

In this arrangement the good material received from the upper layer 126 is indicated by reference numeral 160 and is carried away at a higher level by a convenient support or conveyer 161.

The lights and smalls can be either added to the good material 160 or can be returned to the deck for reclassification.

Figure 15:
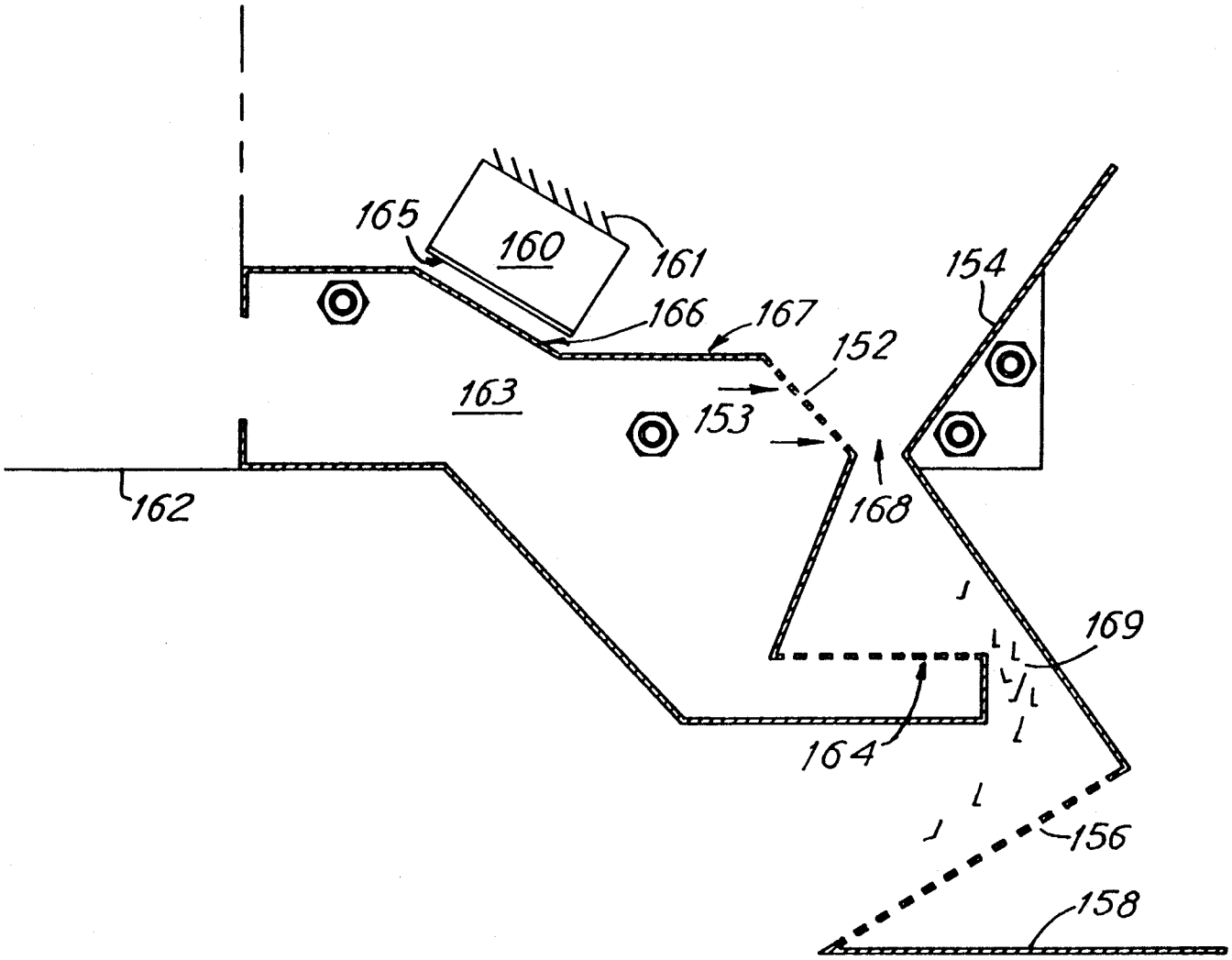
FIG. 15 shows the construction of a "static hammer"

FIG. 15 shows the construction of a hammer which employs the movement of the vibrating deck to achieve a hammering effect. This hammer comprises a solid hammer element 160 rigidly mounted by appropriate means 161. The end of the vibrating deck is indicated by reference numeral 162 and has a rigidly attached tray 163. The tray is sturdily constructed to accommodate the hammering which it will take. The same reference numerals are used in this Figure to indicate similar parts to those shown in FIG. 14, thus, the rigid tray 163 has a perforated ramp 152 through which an air flow 153 can pass. The ramp 154 is also provided but in this construction, a perforated sheet 164 routes further air taken from the plenum chamber to a throat 168 formed between ramps 152 and 154. Only heavy particles can pass through this throat 168; lights being lifted up and over 154. Heavies shown by 169 may then fall onto the sieve 156 for separation into large and small particles as shown in FIG. 14.

In use the movement of the vibrating deck is sufficient to cause the tray 163 to repeatedly approach the fixed hammer means 160 so that material passing between the surfaces 165 and 166 is hammered as required. These surfaces could be flat or indented appropriately. The hammered material now moves over the flat 167 and onto the ramp 152 where the air flow separates away the lights which pass to and over the ramp 154.

It will be appreciated that a hammer mill of the kind described above could be incorporated in any of the constructions described above including the construction as shown in FIGS. 1 to 4 as a form of final treatment for the heavies.

Figure 16:
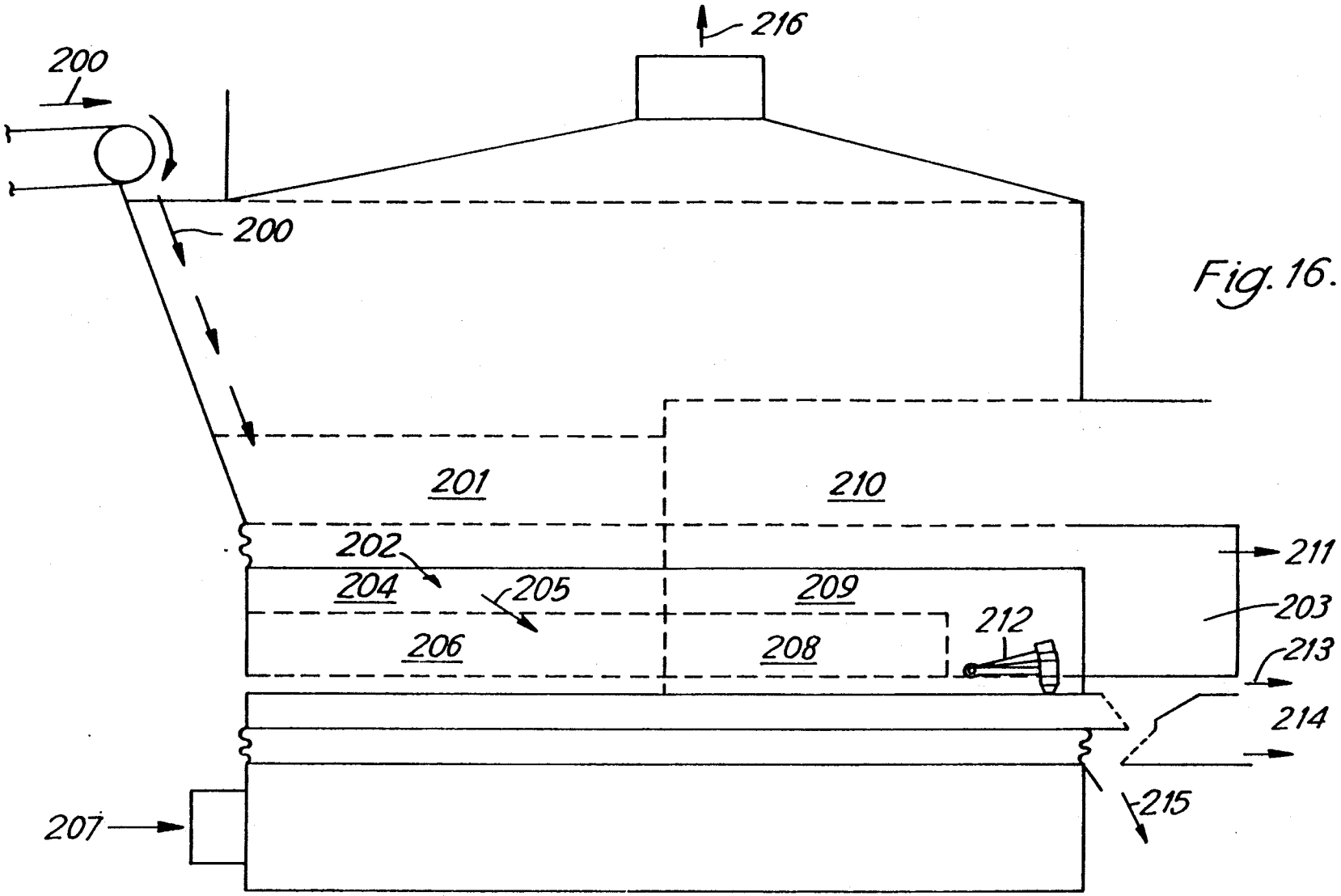
FIG. 16 is a schematic side elevation of apparatus incorporating the invention.

FIG. 16 is a schematic side elevation of apparatus incorporating the invention. In this drawing arrows 200 indicate tobacco being loaded into the apparatus. Location 201 indicates an area where the air flow causes a tossing effect for the incoming tobacco and arrow 202 indicated the tobacco entering the troughs in the vibrating deck 203. The first classification layer or carpet is 204 and arrow 205 indicates the heavies or winnows descending to the bottom the troughs. The lower area 206 indicates that part of the troughs where cleaning of the winnows takes place.

Air for the venturis and stratifying effect is shown entering the apparatus by arrow 207.

Area 208 indicates where the second layer has already been raised to the first layer but there is still some classification taking place within the venturis themselves, caused by the various ramps and air flow effects. The zone indicated by reference numeral 209 is substantially neutral with the good quality material (lamina) moving along it although at 210 there is still some tossing effect taking place. Laminar discharge is indicated by arrow 211 and threshing by the hammer mill is indicated at 212. The exiting lights are at the position of arrow 213, the smalls at arrow 214 and the winnows at arrow 215. The air exiting from the apparatus is indicated by arrow 216.

Figure 17:
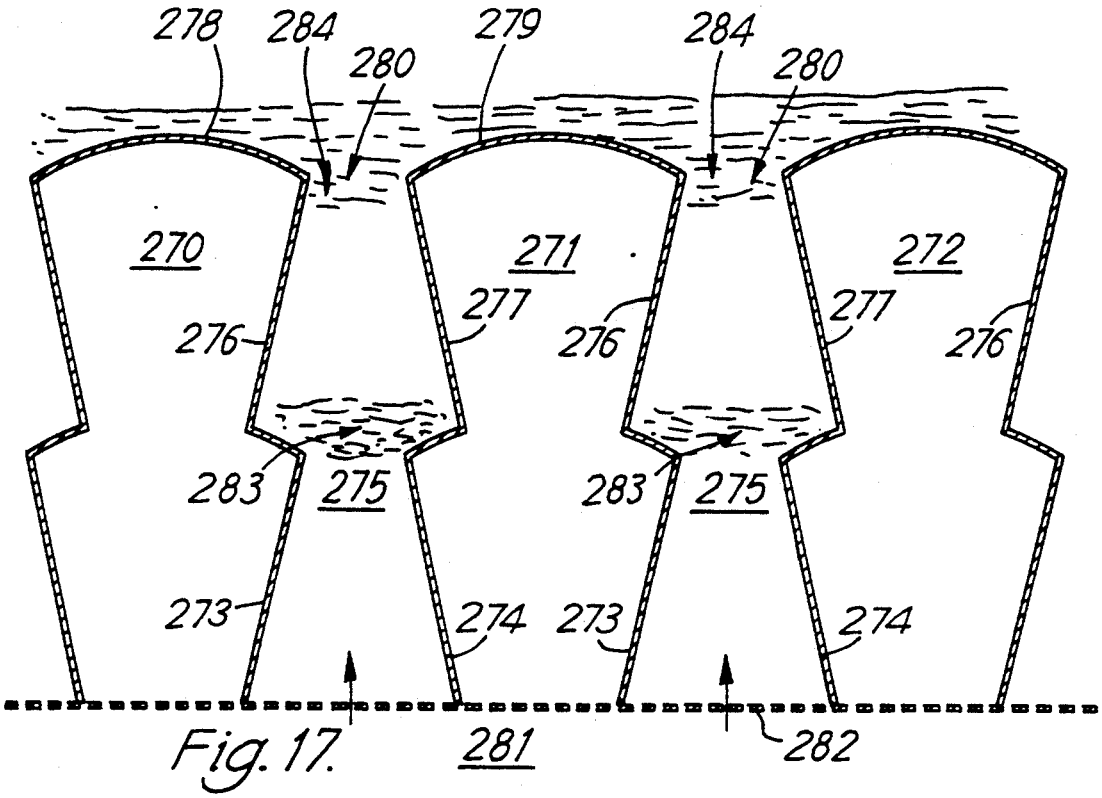
FIGS. 17 and 18 are diagrammatic cross-sections of further trough constructions.
Figure 18:
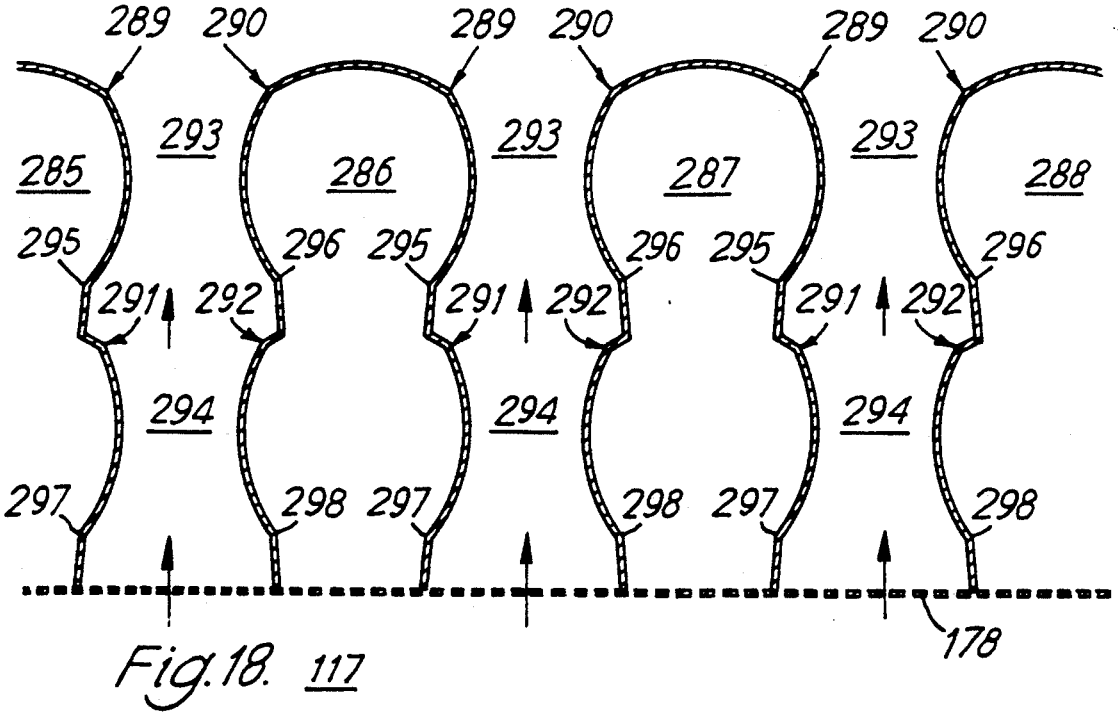

FIGS. 17 and 18 are diagrammatic cross-sectional views of further trough constructions according to the invention using two venturis and show how the air velocity profile required for the bed to work can also be achieved by what is, in effect, selected baffling over a flat perforated sheet. In the construction shown in FIG. 17 the bed has a number of longitudinally extending rail members 270, 271, 272. These rail members are shaped to provide together the trough side walls and peaks. Each trough 100 has lower converging side walls 273, 274 which provide a throat 275 at their upper ends. The walls then diverge and converge again at 276 and 277 and diverge again to provide upper walls 278, 279 which provide a mouth 280 to the trough 100. Air is supplied to the troughs 100 from a plenum chamber 281 and due to the shape of the trough the throat 275 and mouth 280 act as venturis. The air therefore accelerates upwardly through the throat 275 and then slows, then accelerates again up to the throat 280 and then slows down again as it exits through the throat which in the construction shown in FIG. 17 is of a shallow bell shape. Separation zones are formed above or extending into the trough of both venturis at 282 and 284. This type of unit, even when multi-sided shapes are used, is relatively cheap to produce and in applications where cost is critical would be a convenient design. The heavies can be taken off at any convenient point either by openings in the perforated base wall 282 or by allowing the heavies to move to the end of the deck.

FIG. 18 shows another construction of somewhat similar type but in this case the rail members 285, 286, 287, 288 are shaped to provide a deeper bell shaped portion between upper walls 289, 290, 291, 292 respectively above the venturi throats 293, 294. The walls open at 295, 296 and 297, 298.

Although the rail sections are shown as having solid walls air bleeds into the troughs can be provided if desired to further enhance the air flow, and the air bleeds can be in a pattern to provide varying flows at different positions. Air guide means in the form of baffles can also be used to control the air flow into the trough through the walls.

From the above it will be appreciated that the portion of each trough in which a separation zone is created can have any one or a combination of the constructions described above. Thus, the trough could have solid walls and rely upon the shape of the walls to form the separation zone, a typical example being by the use of a venturi. Alternatively, the separation zone could be caused by causing the air flow to increase and decrease by providing a pattern of air holes, the sizes of which vary or the shape of the pattern of which varies. Another alternative is to provide air guiding through air holes in the wall of the trough, for example by the use of baffles. Combinations of these arrangements can also be used. Thus, the wall of the trough could have a pattern of holes and also be provided with baffles or part of the trough wall could be solid and part provided with air holes.

Again, the particular method of air flow control could be the same or different for the two or more separation zones.

Figure 19:
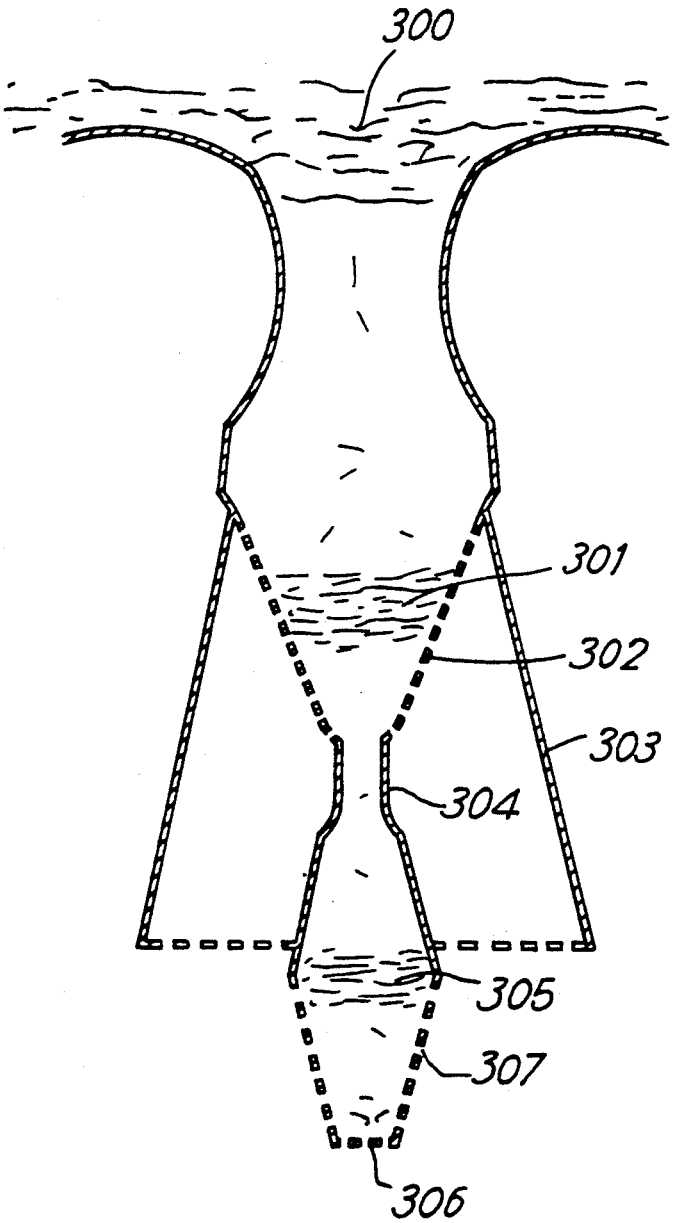
FIG. 19 is a diagrammatic cross-section of a triple separation zone trough construction according to the invention.

FIG. 19 is a cross-sectional diagrammatic view of a construction providing triple separation zones and which utilises different methods of air control for each separation zone.

In this construction the upper separation zone provides a carpet of tobacco material 300 which is formed by a rail structure similar to that shown in FIG. 18. A second separation zone provides a layer of tobacco material 301 which is created at an intermediate point in the trough by ducting an air flow through a perforated portion 302 of the wall of the trough, control of the air being effected by baffles 303. Beneath the perforated wall 302 is a venturi 304 which has a solid wall which continues downwardly in a diverging shape until it reaches a third separation zone 305. The walls of the trough beneath this zone are perforated with a pattern of air holes. The base 306 of the trough is flat and the density of the holes at the base could be, for example, about 10 holes per cm. The lower part of the side walls 307 could have, for example, 8 holes per cm. which reduces to 4 holes per cm. as the wall rises to a separation zone 305. Thus in this part of the construction the air profile is achieved, not only by the shape of the trough but also by the pattern of air holes. The air profile could also be achieved by altering the size of the holes in accordance with a pattern.

I claim:

1. Apparatus for the separation of heavy and light particles from fibrous particulate material which includes means for continuously fluidizing and agitating the fibrous particulate material to cause heavy particles to sink from the light particles comprising a deck adapted to receive material at a reception end thereof, means for vibrating said deck thereby causing the material to move longitudinally along said deck to a discharge end thereof; said deck having a number of longitudinally extending troughs each defined by an upper trough portion, a lower trough portion and a bottom; means for supplying pressurized air to each trough to cause an upwardly directed air flow therein in a direction from each bottom upwardly to each upper trough portion, (a) means for creating a first air velocity at a first upper separation zone in each said upper trough portion which causes separation of the heavy and light particles by lifting the light particles and allowing the heavy particles to fall through the first upper separation zone into a second lower separation zone, and (b) means for creating a second air velocity at the second lower separation zone in each said lower trough portion which gradually increases in velocity toward the first upper separation zone to cause a second separation of heavy and light particles in the second lower separation zone by lifting at least some of the light particles back into the first upper separation zone and allowing the heavy particles to fall down toward the bottom of each lower trough portion into a region of still lower air velocity.

2. The apparatus as defined in claim 1 including means for controlling the first and second air velocities by controlling the respective first and second air velocity creating means.

3. The apparatus as defined in claim 1 wherein said first air velocity creating means includes opposite imperforate upwardly diverging walls defining each said upper trough portion.

4. The apparatus as defined in claim 1 wherein said second air velocity creating means includes opposite perforate walls contiguous each said trough bottom.

5. The apparatus as defined in claim 1 including means for defining a venturi between each trough bottom and lower trough portion.

6. The apparatus as defined in claim 1 including means for controlling the first and second air velocities by controlling the respective first and second air velocity creating means, and said controlling means includes air chamber means exteriorly of and disposed generally along each trough, and a medial trough portion of each trough located between each said upper and lower trough portions includes perforate means for placing said air chamber means in fluid communication with each trough.

7. The apparatus as defined in claim 1 including means for creating a drop in air velocity between said first and second separation zones.

8. The apparatus as defined in claim 1 including means for defining an agitation chamber between said first and second separation zones.

9. The apparatus as defined in claim 1 wherein said longitudinally extending troughs are separated by peaks defining a mouth between adjacent peaks, said first air velocity creating means is constructed and arranged to create said first upper separation zone in an area spanning a distance above and below said peaks, but spaced upwardly from each said second lower separation zone.

10. The apparatus as defined in claim 1 including (c) means for creating a third air velocity at a third separation zone between said first and second separation zones at which there is a drop in air velocity.

11. The apparatus as defined in claim 1 including (c) means for creating a third air velocity at a third separation zone between said first and second separation zones at which there is a drop in air velocity, and venturi means between said second and third separation zones.

12. The apparatus as defined in claim 1 wherein said longitudinally extending troughs are separated by peaks defining a mouth between adjacent peaks, said first air velocity creating means is constructed and arranged to create said first upper separation zone in an area spanning a distance above and below said peaks.

13. The apparatus as defined in claim 12 including means for controlling the first and second air velocities by controlling the respective first and second air velocity creating means.

14. The apparatus as defined in claim 12 wherein said second air velocity creating means includes opposite perforate walls contiguous each said trough bottom.

15. The apparatus as defined in claim 12 including means for defining a venturi between each trough bottom and lower trough portion.

16. The apparatus as defined in claim 12 including means for controlling the first and second air velocities by controlling the respective first and second air velocity creating means, and said controlling means includes air chamber means exteriorly of and disposed generally along each trough, and a medial trough portion of each trough located between each said upper and lower trough portions includes perforate means for placing said air chamber means in fluid communication with each trough.

17. The apparatus as defined in claim 12 including means for creating a drop in air velocity between said first and second separation zones.

18. The apparatus as defined in claim 12 wherein said first air velocity creating means includes opposite imperforate upwardly diverging walls defining each said upper trough portion.

19. The apparatus as defined in claim 18 wherein said second air velocity creating means includes opposite perforate walls contiguous each said trough bottom.

20. The apparatus as defined in claim 18 including means for defining a venturi between each trough bottom and lower trough portion.

21. The apparatus as defined in claim 18 including means for controlling the first and second air velocities by controlling the respective first and second air velocity creating means, and said controlling means includes air chamber means exteriorly of and disposed generally along each trough, and a medial trough portion of each trough located between each said upper and lower trough portions includes perforate means for placing said air chamber means in fluid communication with each trough.

22. The apparatus as defined in claim 18 including means for creating a drop in air velocity between said first and second separation zones.

* * * * *